US006340852B1

(12) United States Patent
Mizoguchi

(10) Patent No.: US 6,340,852 B1
(45) Date of Patent: Jan. 22, 2002

(54) VOLTAGE GENERATING CIRCUIT CAPABLE OF STABLY SUPPLYING POWER SUPPLY VOLTAGE LESS THAN RATED VOLTAGE

(75) Inventor: Shinichi Mizoguchi, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/437,094

(22) Filed: Nov. 9, 1999

(30) Foreign Application Priority Data

May 27, 1999 (JP) ..... 11-148582

(51) Int. Cl.[7] ..... G05F 5/08
(52) U.S. Cl. ..... 307/125; 323/273
(58) Field of Search ..... 307/75, 125, 130; 323/272, 273, 349; 365/226

(56) References Cited

U.S. PATENT DOCUMENTS 4,730,122 A * 3/1988 Dreibelbis et al. ..... 307/75
5,021,728 A * 6/1991 Sato ..... 323/272
5,079,497 A * 1/1992 Barbu et al. ..... 323/274
5,373,227 A * 12/1994 Keeth ..... 323/274
5,424,629 A * 6/1995 Fujiwara et al. ..... 323/349
5,514,951 A * 5/1996 Halim et al. ..... 323/281
5,828,892 A * 10/1998 Mizuta ..... 365/226
5,929,539 A * 7/1999 Kozaru et al. ..... 307/130
5,940,069 A * 8/1999 Moon ..... 307/125
5,973,489 A * 10/1999 Dourlain ..... 323/299
5,982,158 A * 11/1999 Schnars et al. ..... 323/273
5,994,886 A * 11/1999 Shinozaki ..... 323/303
6,084,386 A * 7/2000 Takahashi et al. ..... 323/273
6,184,669 B1 * 2/2001 Matsuo ..... 323/273
6,188,210 B1 * 2/2001 Tichauer et al. ..... 323/273

FOREIGN PATENT DOCUMENTS

JP 6-149395 5/1994
JP 07-211869 * 8/1995
JP 10-74394 3/1998

* cited by examiner

*Primary Examiner*—Josie Ballato
*Assistant Examiner*—Roberto Rios
(74) *Attorney, Agent, or Firm*—McDermott, Will & Emery

(57) ABSTRACT

A voltage generating circuit according to the present invention includes an external power supply interconnection supplied with an external power supply voltage, an internal power supply interconnection to supply an internal power supply voltage to a load, a regulator circuit which receives the output of the external power supply interconnection and generates a rated voltage for the internal power supply voltage, a voltage switch transistor to connect the external power supply interconnection and the internal power supply interconnection. The regulator circuit and voltage switch transistor are complementarily activated based on the voltage level of a control node. The voltage generating circuit further includes a voltage switch circuit to switch the voltage level of the control node based on the voltage level of the external power supply interconnection.

11 Claims, 8 Drawing Sheets

VOLTAGE GENERATING CIRCUIT CAPABLE OF STABLY SUPPLYING POWER SUPPLY VOLTAGE LESS THAN RATED VOLTAGE

BACKGROUND OF THE INVENTION

1. Field of the Invention

The present invention relates generally to voltage generating circuits, and more specifically to a voltage generating circuit which can stably supply internal power supply voltage not exceeding rated voltage for the internal power supply voltage when external power supply voltage higher than the rated voltage is applied.

2. Description of the Background Art

In order to cope with the need for semiconductor devices having larger capacity and operating at higher speed, efforts have been made to reduce the size of elements. To cope with reduction in the breakdown voltage of the elements associated with such miniaturization, the operation power supply voltage has been lowered from the conventional 5V to 3.3V. Thus, some ICs including a semiconductor device are manufactured to have a rated value of 3.3V for the operation-guaranteed voltage, while the others still have the conventional, rated voltage value of 5V.

Under the circumstances, devices with various rated voltages are in the market such as PC card slots installed in PCs or the like and in these IC-installed circuits, the rated voltage can be 3.3V or 5V, or some devices are adapted to operate selectively with any of 3.3V or 5V.

Therefore, when an IC having an operation-guaranteed voltage of 3.3V is installed, a voltage generating circuit which can stably output 3.3V as an output power supply voltage is necessary in order to guarantee the operation of the IC as a board capable of operating with both 5V and 3.3V.

Japanese Patent Laying-Open No. 6-149395 discloses a voltage generating circuit for such an application incorporated in a semiconductor device. (Hereinafter, the disclosed voltage generating circuit will be referred to as "conventional voltage generating circuit".)

FIG. 12 is a schematic block diagram showing the general configuration of a conventional voltage generating circuit 500.

Referring to FIG. 12, voltage generating circuit 500 receives an external power supply voltage VCE at an external power supply terminal 510 and supplies an internal power supply voltage Vcc to an internal circuit power supply interconnection 590. The operation power supply voltage is supplied through internal circuit power supply interconnection 590 to an internal circuit 550. Internal circuit 550 includes a decoder circuit 555, a sense amplifier circuit 556 and a control circuit 557.

Voltage generating circuit 500 includes a voltage down-converting circuit 520 to convert external power supply voltage VCE to internal power supply voltage Vcc, a power supply voltage detecting circuit 530 to detect the size of external power supply voltage VCE to send a control signal for controlling a switch circuit 540, and switch circuit 540 to transmit one of the output of voltage down-converting circuit 520 and external power supply voltage VCE to internal circuit power supply interconnection 590 in response to the control signal.

Voltage generating circuit 500 stably supplies a voltage of 3.3V, a rated value for the internal power supply voltage to internal circuit 550 if external power supply voltage VCE is either 5V or 3.3V.

FIG. 13 is a circuit diagram of the configuration of switch circuit 540.

Referring to FIG. 13, switch circuit 540 includes a P-type MOS transistor Q31 and an N-type MOS transistor Q32 forming a transfer gate which connects an external power supply interconnection 570 and internal circuit power supply interconnection 590 in response to an activation of a control signal MO1. Switch circuit 540 further includes a P-type MOS transistor Q33 and an N-type MOS transistor Q34 forming a transfer gate which connects voltage down-converting circuit 520 and internal circuit power supply interconnection 590 in response to an activation of a control signal M02.

Thus, when external power supply voltage VCE is 5V, control signal MO1 attains an H level (active state) and control signal M02 attains an L level (inactive state), so that the output of voltage down-converting circuit 520 is transmitted to internal circuit power supply interconnection 590. Meanwhile, when external power supply voltage VCE is 3.3V, control signal MO1 attains an L level, and control signal M02 attains an H level, so that external power supply voltage VCE is directly transmitted to internal circuit power supply interconnection 590.

FIG. 14 is a circuit diagram of the configuration of a power supply voltage detecting circuit 530.

Referring to FIG. 14, power supply voltage detecting circuit 530 includes P-type MOS transistors Q21, Q22 and an N-type MOS transistor Q23 connected in series between external power supply voltage interconnection 570 and a ground interconnection 580. The substrate region of transistor Q21 is connected to external power supply interconnection 570. The substrate region of transistor Q22, the gate of transistor Q21 and the source of transistor Q22 are connected to the drain of transistor Q21. The gate and drain of transistor Q22 are connected to a node Nx. Transistor Q23 is connected between node Nx and ground interconnection 580 and has a gate connected to ground interconnection 580.

Power supply voltage detecting circuit 530 further includes a P-type MOS transistor Q24 and an N-type MOS transistor Q25 forming an inverter which inverts the voltage level of node Nx for output to an internal node Ny, and a P-type MOS transistor Q26 and an N-type MOS transistor Q27 forming an inverter which inverts the voltage level of a node Ny for output to a node Nz.

Transistors Q24 and Q25 are connected in series between external power supply interconnection 570 and ground interconnection 580, and have their gates connected to node Nx. Transistors Q26 and Q27 are connected between external power supply interconnection 570 and ground interconnection 580 and have a gate connected to node Ny. The voltage level of control signal MO1 is equal to the voltage level of node Nz, while the voltage level of control signal MO2 is equal to the voltage level of node Ny. Control signals MO1 and MO2 are transmitted to switch circuit 540.

In power supply voltage detecting circuit 530, the voltage level of node Nx changes according to the level of external power supply voltage VCE.

If external power supply voltage $VCE \leqq 2 \cdot |VTP|$ (VTP: the threshold voltage of P-type transistors) holds, transistors Q21 and Q22 are in an off state, the voltage of node Nx is 0V (ground voltage). At this time, the voltage levels of nodes Ny and Nz are VCE and 0V, respectively by the function of the inverters formed by transistors Q24 to Q27. More specifically, control signal MO1 attains an L level, while control signal MO2 attains an H level.

If external power supply voltage $VCE \geqq 2 \cdot |VTP| + VI$ (VI: the logical threshold of inverters) holds, the voltage level of node Nx changes from 0V to VCE, the polarities of control signals MO1 and MO2 are inverted as the voltage levels of node Ny and Nz change, and control signal MO1 attains an H level, while control signal MO2 attains an L level.

Thus, if the threshold voltage VTP of a P-type transistor and the logical threshold VI of an inverter are designed appropriately, voltage generating circuit 500 can select whether to directly supply the external power supply voltage or supply the output of voltage down-converting circuit 520 to the internal circuit depending upon the result of the comparison between external power supply voltage VCE and a prescribed voltage level.

However, in this conventional voltage generating circuit 500, before external power supply interconnection 570 is activated, in other words before voltage is actually supplied to external power supply interconnection 570, VCE=0V holds, and therefore control signal MO1 attains an L level, so that external power supply interconnection 570 and internal circuit power supply interconnection 590 are connected by switch circuit 540.

Let us assume that, in this state, the external power supply is activated, and external power supply voltage VCE is raised from 0V to 5V. In this case, in response to the rising of external power supply voltage VCE, the output of switch circuit 540 to internal circuit power supply interconnection 590 should be switched from external power supply interconnection 570 to voltage down-converting circuit 530 in order to stably supply power supply voltage not exceeding 3.3V, i.e., the rated voltage for internal circuit 550.

In practice, however, the voltage levels of nodes Nx, Ny and Nz in power supply voltage detecting circuit 530 change, which causes the polarities of control signals MO1 and MO2 to be inverted, so that there is a prescribed time delay until internal circuit power supply interconnection 590 and external power supply interconnection 570 are disconnected by switch circuit 540.

The presence of the time delay causes external power supply voltage VCE to rise as internal circuit power supply interconnection 590 and external power supply interconnection 570 are connected immediately after the activation of the external power supply, and the peak of the internal power supply voltage could be as high as the maximum input voltage level (5V). This could cause the ICs whose internal power supply voltage is 3.3V installed in each circuit in internal circuit 550 to be destroyed with the applied voltage higher than the rated voltage.

Also when a circuit group having ICs of different operation rated voltages are allowed to operate under a common external power supply interconnection, a voltage generating circuit capable of stably supplying the operation voltage (3.3V) on the lower voltage side irrespectively of the voltage level supplied to the external power supply interconnection is necessary for the same reasons as above.

SUMMARY OF THE INVENTION

It is one object of the present invention to provide a voltage generating circuit capable of stably supplying an internal power supply voltage not exceeding a rated voltage if an external power supply voltage higher than the rated voltage for the internal power supply voltage is applied.

Briefly stated, a voltage generating circuit according to the present invention receives an external power supply voltage, generates an operation power supply voltage of a predetermined value and includes an external power supply interconnection, an internal power supply interconnection, a control node, an output switch circuit, an auxiliary voltage generating circuit, and a voltage switch control circuit.

The external power supply interconnection transmits an external power supply voltage. The internal power supply interconnection transmits the operation power supply voltage. The output switch circuit is activated based on the voltage level of the control node to connect the external power supply interconnection and the internal power supply interconnection. The auxiliary voltage generating circuit is connected between the external power supply interconnection and internal power supply interconnection and activated complementarily with the output switch circuit based on the voltage level of the control node to supply the voltage of the predetermined value to the internal power supply interconnection. The voltage switch control circuit controls the voltage of the control node to activate the auxiliary voltage generating circuit at the time of the activation of the external power supply interconnection and to activate the output switch circuit based on the voltage level of the external power supply interconnection after the activation and the voltage level of the external power supply interconnection is stabilized.

A voltage generating circuit according to another aspect of the present invention receives an external power supply voltage, generates a voltage of a predetermined value as an operation power supply voltage, and includes an external power supply interconnection, an internal power supply interconnection, a control node, an output switch circuit, an auxiliary voltage generating circuit, a voltage switch control circuit, and a voltage supply cut off circuit.

The external power supply interconnection transmits an external power supply voltage. The internal power supply interconnection transmits an operation power supply voltage. The output switch circuit is activated based on the voltage level of the control node to supply a voltage from the external power supply interconnection to the internal power supply interconnection. The auxiliary voltage generating circuit is connected between the external power supply interconnection and the internal power supply interconnection and activated complementarily with the output switch circuit based on the voltage level of the control node to supply the voltage of the predetermined value to the internal power supply interconnection. The voltage switch control circuit controls the voltage of the control node to activate the output switch circuit when the voltage level of the external power supply voltage is not more than a first reference voltage set higher than the rated voltage. The voltage supply cut off circuit stops the supply of voltage by the external power supply interconnection and the auxiliary voltage generating circuit until the voltage level of the external power supply interconnection is stabilized.

Therefore, a main advantage of the present invention lies in that until the voltage level of the external power supply interconnection is stabilized, voltage is supplied to the internal power supply interconnection by the auxiliary voltage generating circuit, so that stable voltage not exceeding the rated voltage can be supplied after the activation, and after the voltage level is stabilized, the auxiliary voltage generating circuit may be inactivated based on the voltage level of the external power supply interconnection to reduce the power consumption.

By the function of the voltage supply cut off circuit, voltage supply to the internal power supply interconnection is temporarily stopped during a prescribed period at the rising of the external power supply voltage, the internal power supply voltage may be controlled so as not to exceed the level of the rated voltage.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
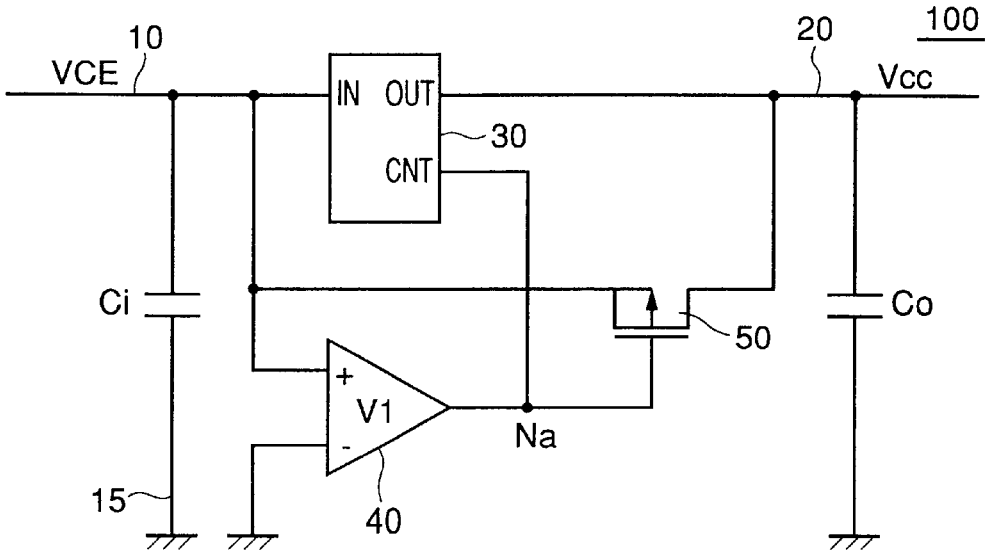
FIG. 1 is a circuit diagram of a voltage generating circuit 100 for use in illustration of a voltage generating circuit according to a first embodiment of the present invention.

Embodiments of the present invention will be now described in conjunction with the accompanying drawings in which the same reference characters refer to the same or corresponding portions.

First Embodiment

FIG. 1 is a circuit diagram of the configuration of a voltage generating circuit 100 for use in illustration of a voltage generating circuit according to a first embodiment of the present invention.

Similarly to the conventional voltage generating circuit 500, voltage generating circuit 100 connects one of an external power supply interconnection 10 and the output of a regulator circuit 30 to an internal power supply interconnection 20 based on the voltage level of an external power supply voltage VCE to supply an internal power supply voltage Vcc to a load.

According to the embodiment of the present invention, when external power supply voltage VCE whose rated value is one of 5V and 3.3V is supplied from an external power supply interconnection, the voltage generating circuit can stably supply an internal power supply voltage of the rated value (3.3V), but the voltage level such as 5V and 3.3V is simply by way of illustration, and the invention is not limited to such applications.

Referring to FIG. 1, voltage generating circuit 100 includes external power supply interconnection 10 to which external power supply voltage VCE is transmitted, internal power supply interconnection 20 used to supply a load with internal power supply voltage Vcc, regulator circuit 30 which receives external power supply voltage VCE at its input terminal and generates an output voltage of 3.3V, which is a rated value for internal power supply voltage Vcc from its output terminal, and a voltage switch transistor 50 activated based on the voltage level of node Na to connect external power supply interconnection 10 and internal power supply interconnection 20.

Regulator circuit 30 further includes an output control terminal CNT, and when an L level signal is input to output control terminal CNT, regulator circuit 30 is inactivated to stop the output voltage (3.3V) to output terminal OUT from being generated. More specifically, based on the voltage level of node Na, one of regulator circuit 30 and voltage switch transistor 50 is complementarily activated.

Voltage generating circuit 100 further includes a comparator 40 which determines the voltage level of node Na based on external power supply voltage VCE.

Comparator 40 outputs an H level voltage to node Na when external power supply voltage VCE is higher than a reference voltage V1. Comparator 40 is formed by a differential amplifier circuit or the like using an operation amplifier. Reference voltage V1 has only to be set higher than the level of the rated value for internal power supply voltage Vcc and lower than the peak value of the external power supply voltage, and set to 3.9V for example in the case of FIG. 1.

Voltage generating circuit 100 further includes capacitors Ci and Co to stabilize the voltages of external power supply interconnection 10 and internal power supply interconnection 20.

When external power supply voltage VCE is higher 3.3V ($\leqq$V1), voltage generating circuit 100 inactivates regulator 30 to stop the output voltage from being generated by rendering the voltage of node Na to be an L level using comparator 40, and turns on power switch transistor 50 to connect external power supply interconnection 10 and internal power supply interconnection 20. Thus, when external power supply voltage VCE is 3.3V, the internal power supply voltage is directly supplied from external power supply interconnection VCE to internal power supply interconnection 20.

Meanwhile, when external power supply voltage VCE is 5V ($\geqq$V1), comparator 40 outputs an H level voltage to node Na. Thus, voltage switch transistor 50 is turned off and the operation of regulator circuit 30 is activated. Therefore, if external power supply voltage VCE is 5V, internal power supply interconnection 20 and external power supply interconnection 10 are disconnected, so that the output voltage of regulator circuit 30 is supplied to internal power supply interconnection 20.

Thus, when the external power supply voltage exceeds the rated value for the internal power supply voltage, the voltage down converted by regulator circuit 30 is supplied as the internal power supply voltage, while when the external power supply voltage is at the level of the rated value for the internal power supply voltage, regulator circuit 30 is inactivated to directly supply the internal power supply voltage from the external power supply interconnection, so that voltage generating circuit 100 can stably supply the internal power supply voltage while reducing the entire power consumption.

Voltage generating circuit 100 suffers from the problems associated with the conventional circuit, in other words, when external VCE rises from 0V to 5V, depending upon the responsiveness of comparator 40, the potential of external power supply interconnection 10 rises during the period in which the voltage level of node Na changes from an L level to an H level, so that the peak of internal power supply voltage Vcc is raised to a level as high as the maximum level (5V) of the external power supply voltage.

Figure 2:
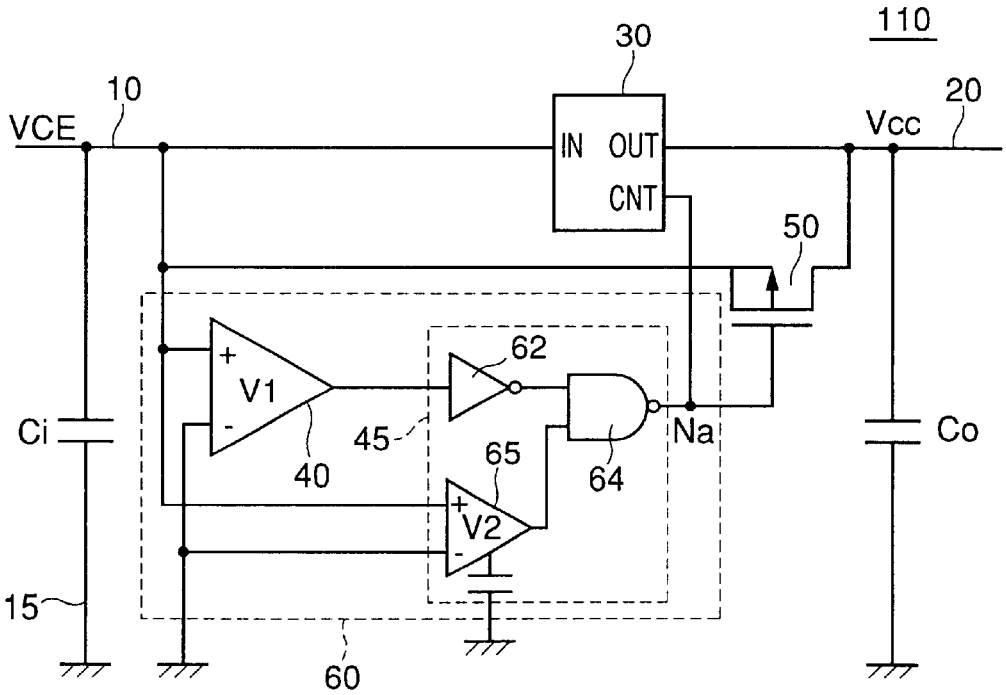
FIG. 2 is a circuit diagram of the general configuration of a voltage generating circuit 110 according to the first embodiment.

FIG. 2 is a circuit diagram of the configuration of a voltage generating circuit 110 according to the first embodiment of the present invention.

Referring to FIG. 2, voltage generating circuit 110 is different from voltage generating circuit 100 in that there is provided a voltage switch control circuit 60 including a comparator circuit 40.

In voltage generating circuit 110, the voltage level of node Na is controlled by voltage switch control circuit 60 rather than directly set by the output of comparator circuit 40.

The object of providing voltage generating circuit 110 is to stably control the internal power supply voltage not to exceed the rated value by the function of voltage switch control circuit 60, in a rising timing of the external power supply voltage.

Voltage switch control circuit 60 includes comparator 40 described in conjunction with FIG. 1 and a switch setting circuit 45 provided between comparator 40 and node Na.

Switch setting circuit 45 includes an inverter 62 to invert the output of comparator 40, a comparator with delay circuit 65 which outputs a voltage signal after a prescribed time period td if external power supply voltage VCE exceeds a reference voltage V2, and a logic gate 64 which receives the outputs of inverter 62 and comparator with delay circuit 65 and outputs the result of an NAND operation.

Similarly to voltage generating circuit 100, comparator 40 outputs an H level voltage when external power supply voltage VCE is not less than reference voltage V1. Reference voltage V2 has only to be set lower than the rated value for internal power supply voltage Vcc. If the rated voltage is 3.3V as in this embodiment, for example V1=3.9V and V2=2.6V.

The operation of voltage generating circuit 110 when the external power supply voltage is raised at the time of activation will be now described.

Figure 3:
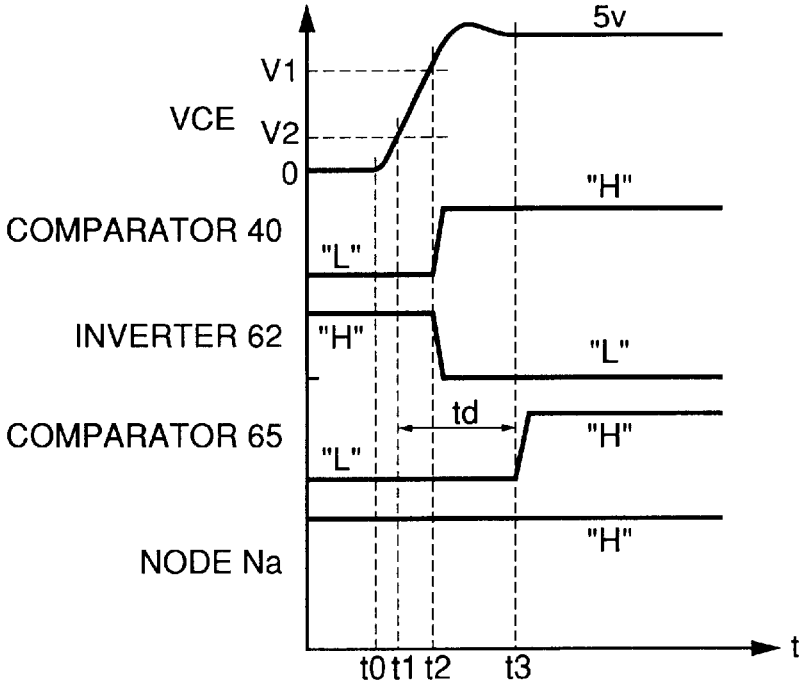
FIG. 3 is an operation waveform chart for use in illustration of the operation of voltage generating circuit 110 when the external power supply voltage is raised from 0V to 5V.

FIG. 3 is an operation waveform chart for use in illustration of voltage generating circuit 10 when the external power supply voltage is raised from 0V to 5V.

Referring to FIG. 3, at time t0, the external power supply is activated and external power supply voltage VCE starts to rise accordingly. At time t1, external power supply voltage VCE reaches V2 (2.6V) which is the reference voltage of comparator with delay circuit 65, the output of comparator with delay circuit 65 is maintained at an L level by the function of the delay circuit until a prescribed time delay td passes.

At time t2, external power supply voltage VCE reaches the reference voltage V1 (3.9V) of comparator 40, and therefore the output of comparator 40 changes to an H level. The output of inverter 62 attains an L level accordingly.

At time t3 after a prescribed time delay td since time t1, comparator with delay circuit 65 is raised to an H level. Time delay td is set in view of time period until external power supply voltage VCE reaches a steady state, the output of inverter 62 has been already changed to an L level in the timing in which the output of comparator with delay circuit 65 is switched to an H level.

Thus, the voltage level of node Na is maintained at an H level. Since transistor 50 maintains its off state, internal power supply interconnection 20 is constantly supplied with the output voltage of regulator circuit 30. When the external power supply voltage is raised from 0V to 5V, external power supply voltage VCE will not be directly transmitted to internal power supply interconnection 20 accordingly, and voltage exceeding the rated value (3.3V) for the internal power supply voltage can be prevented from being generated irrespectively of the responsiveness of internal power supply interconnection 20.

Figure 4:
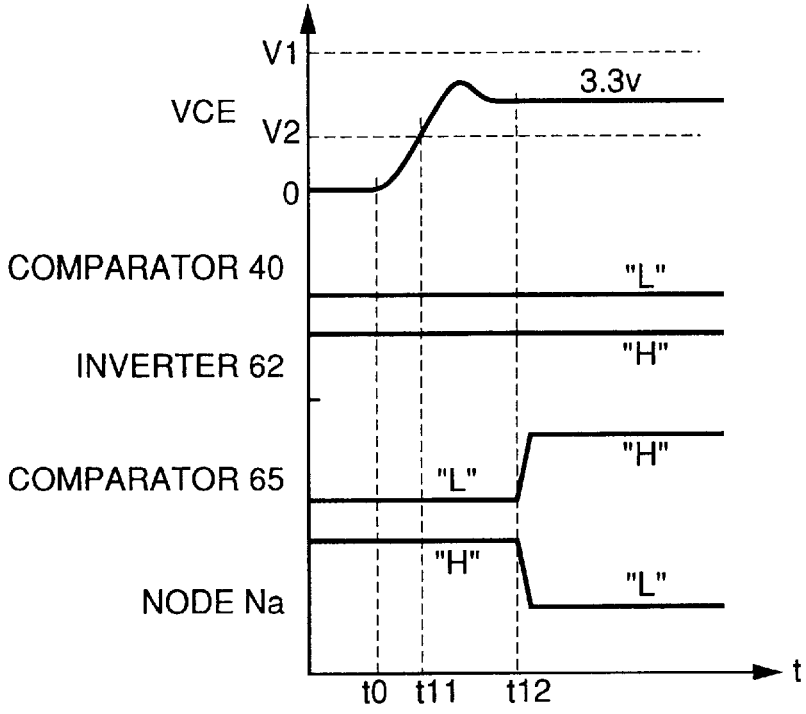
FIG. 4 is an operation waveform chart for use in illustration of the operation of voltage generating circuit 110 when the external power supply voltage is raised from 0V to 3.3V.

FIG. 4 is an operation waveform chart for use in illustration of the operation of voltage generating circuit 110 when the external power supply voltage is raised from 0V to 3.3V.

Referring to FIG. 4, the external power supply is activated at time t0 and external power supply voltage VCE starts to rise. External power supply voltage VCE reaches the reference voltage V2 (2.6V) of comparator with delay circuit 65 at time t11, but the output of comparator with delay circuit 65 is maintained at an L level until a prescribed time td passes by the function of the delay circuit.

Meanwhile, the rated value (3.3V) for the external power supply voltage is lower than the reference voltage V1 (3.9V) of comparator 40, the output of comparator 40 is constant at an L level. The output of inverter 62 maintains an H level accordingly.

Thus, during the period in which the output of comparator with delay circuit 65 is maintained at an L level, the voltage level of node Na is an H level, and transistor 50 is in an off state, while regulator circuit 30 is activated. During this period, internal power supply interconnection 20 is supplied with the output voltage of regulator circuit 30, and therefore voltage higher than the rated value (3.3V) can be prevented from being generated as the internal power supply voltage.

At time t12 after a prescribed time delay since time t11, when the output of comparator with delay circuit 65 is raised to an H level, the voltage level of node Na changes from an H level to an L level, because the output of inverter 62 is maintained at an H level.

Thus, at time t12, internal power supply interconnection 20 and the external power supply interconnection are connected by the conduction of transistor 50. Delay time td is set in view of the time period until external power supply voltage VCE attains a steady state, if internal power supply interconnection 20 is supplied with external power supply voltage VCE, a transient peak voltage exceeding the rated voltage (3.3V) will not be generated at internal power supply interconnection 20.

Therefore, if external power supply voltage is raised from 0V to 3.3V, voltage exceeding a rated level (3.3V) in the internal power supply voltage may be prevented from being generated. Furthermore, after external power supply voltage VCE attains a steady state, regulator circuit 30 may be inactivated to reduce the power consumption.

Therefore, if external power supply voltage is either 3.3V or 5V, stable voltage can be supplied to the internal power supply interconnection immediately after the activation while preventing transient peak voltage exceeding the rated voltage from being generated.

The use of a MOS transistor with small on-resistance for voltage switch transistor 50 permits voltage drop generated between external power supply voltage VCE and internal power supply voltage Vcc to be restrained to a low level.

Reference voltages V1 and V2 are set to 3.9V and 2.6V simply by way of illustration. More specifically, if V1, the reference voltage of comparator 40 is set higher than the rated voltage for internal power supply voltage Vcc, while V2, the reference voltage of comparator with delay circuit 65 is set lower than the rated voltage, the same effects can be provided.

Time delay td set by comparator 40 needs only be set such that the output voltage level of the comparator is not switched to an H level until external power supply voltage VCE supplied to external power supply interconnection 10 attains a steady state as previously described, and the time delay needs only be determined after the stability of external power supply voltage VCE at a rising is evaluated or confirmed.

Modification of First Embodiment

Figure 5:
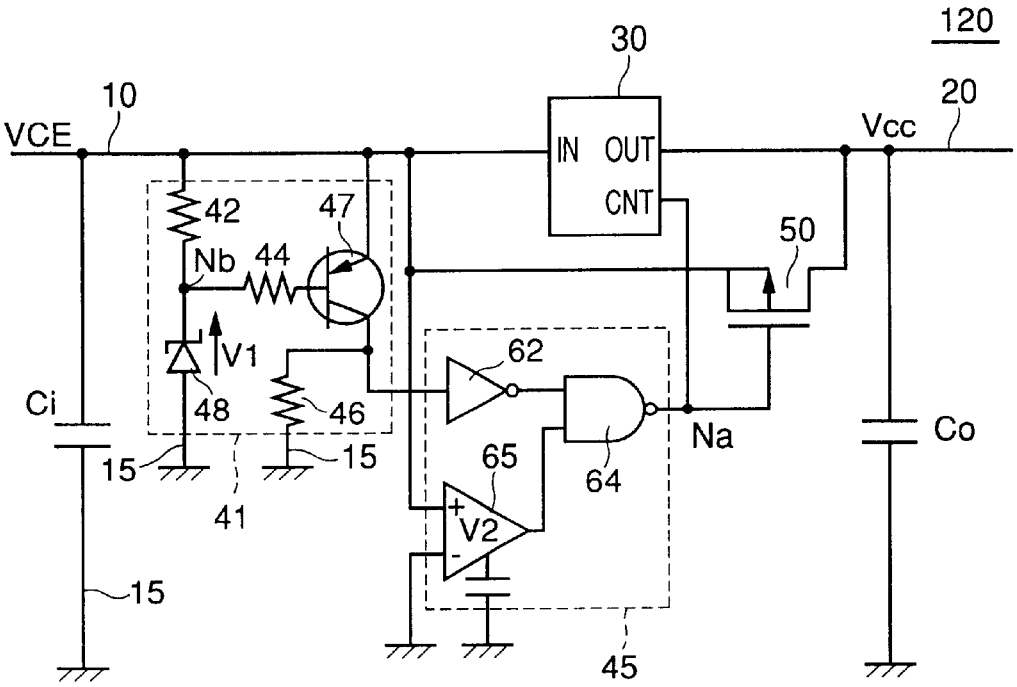
FIG. 5 is a circuit diagram of the general configuration of a voltage generating circuit 120 according to a modification of the first embodiment.

FIG. 5 is a circuit diagram of the general configuration of a voltage generating circuit 120 according to a modification of the first embodiment of the present invention.

Referring to FIG. 5, voltage generating circuit 120 is different from voltage generating circuit 110 according to the first embodiment in that there is provided a voltage comparison circuit 41 in place of comparator 40. The other configuration and operation are the same as those of voltage generating circuit 110, and no additional description is provided.

Voltage comparison circuit 41 includes a PNP transistor 47 provided to electrically connect external power supply interconnection 10 and the input node of inverter 62, a resistor 46 provided between the collector of transistor 47 and a ground interconnection 15, a resistor 44 provided between a node Nb and the base of transistor 47, a resistor 42 connected between external power supply interconnection 10 and node Nb, a zener diode 48 connected between node Nb and ground interconnection 15 and having a breakdown voltage V1. Voltage drop generated at zener diode 48 permits the voltage level of node Nb connected to the base of transistor 47 to be maintained at a level not more than reference voltage V1.

Thus, the base-emitter voltage of transistor 47 increases when external power supply voltage VCE is equal to or higher than reference voltage V1, and transistor 47 conducts. More specifically, in this configuration, voltage comparison circuit 41 provides the same effects as those provided by comparator 40 in voltage generating circuit 110.

Although operating similarly to voltage generating circuit 110, voltage generating circuit 120 achieves the effects provided by comparator 40 which uses an operation amplifier by voltage comparison circuit 41 including a zener diode, a transistor and resistors, it can advantageously provide the same effects less costly.

Second Embodiment

Figure 6:
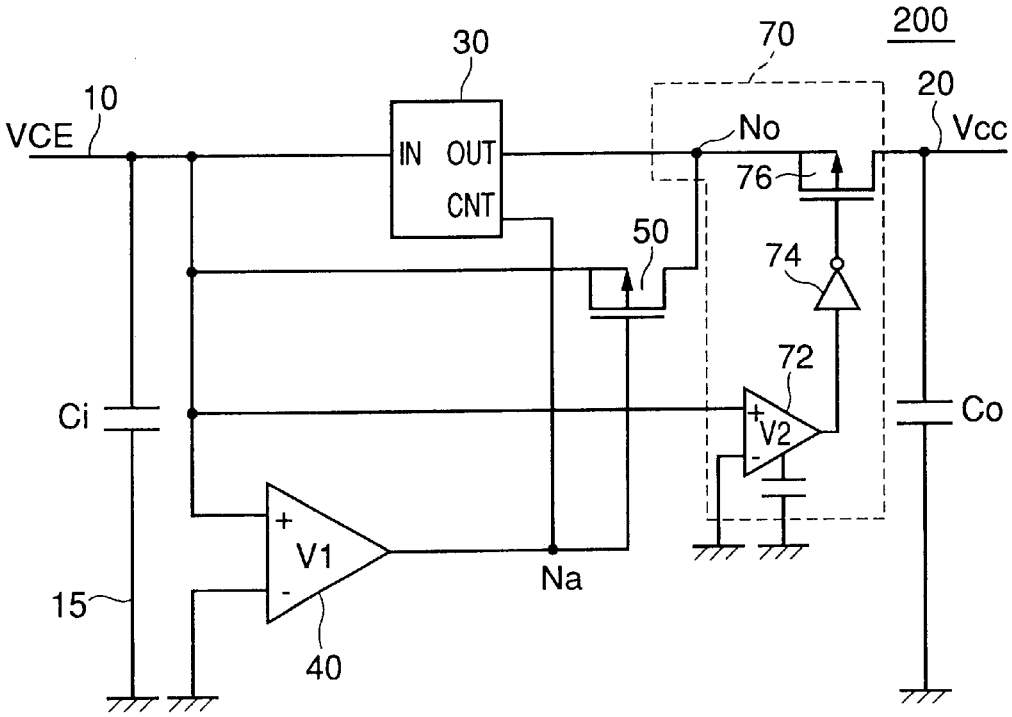
FIG. 6 is a circuit diagram of the general configuration of a voltage generating circuit 200 according to a second embodiment of the present invention.

FIG. 6 is a circuit diagram of the configuration of a voltage generating circuit 200 according to a second embodiment of the present invention.

Referring to FIG. 6, voltage generating circuit 200 is different from voltage generating circuit 100 in FIG. 1 in that a voltage cut off control circuit 70 is provided between an output node No connected to the output terminal of regulator circuit 30 and voltage switch transistor 50 and internal power supply interconnection 20. Voltage generating circuit 200 is directed to such a control that internal power supply voltage Vcc will not exceed the rated voltage by temporarily stopping the supply of power supply voltage to internal power supply interconnection 20 during a prescribed time period at a rising of external power supply voltage VCE by the function of voltage cut off control circuit 70.

Since regulator circuit 30, comparator 40 and voltage switch transistor 50 operate similarly to those of voltage generating circuit 110 according to the first embodiment, no additional description is provided.

Voltage cut off control circuit 70 includes a comparator with delay circuit 72 which outputs an H level voltage after a prescribed time delay td when the input voltage is equal to or higher than reference voltage V2, an inverter 74 which inverts the output of comparator with delay circuit 72, and a voltage cut off transistor 76 which receives the output of inverter 74 at a gate and is connected between the output terminal of regulator circuit 30 and internal power supply interconnection 20.

Similarly to the first embodiment, comparator 40 outputs an H level voltage when external power supply voltage VCE is equal to or higher than reference voltage V1. Reference voltage V1 is set to for example 3.9V not less than a rated voltage for internal power supply voltage Vcc (3.3V for example), and reference voltage V2 is set to 2.6V equal to or lower than the rated voltage.

In voltage generating circuit 200, voltage cut off transistor 76 is turned off for a prescribed period until the external power supply voltage attains a steady state, so that voltage supply output internal power supply interconnection 20 is stopped, then voltage cut off transistor 76 is turned on to start supplying the internal power supply voltage to internal power supply interconnection 20.

Figure 7:
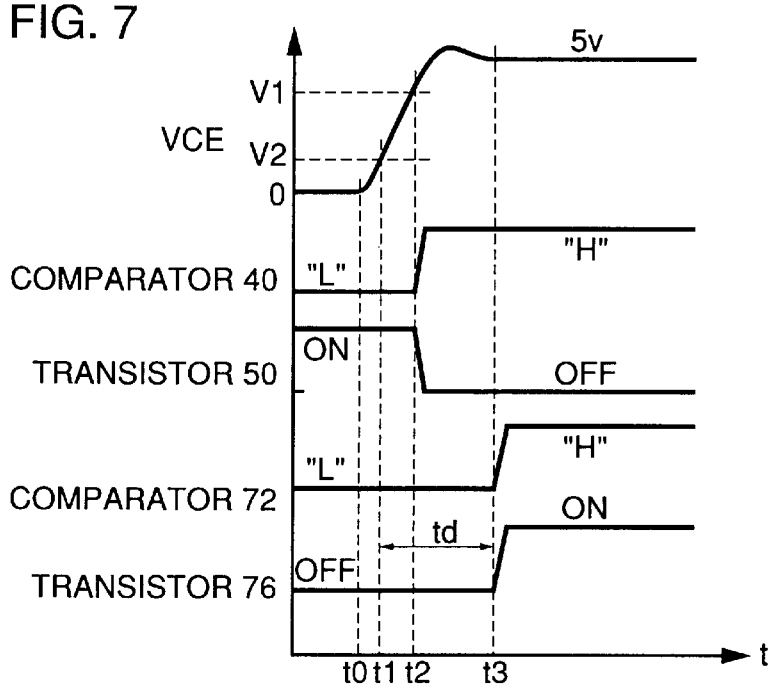
FIG. 7 is an operation waveform chart for use in illustration of the operation of a voltage generating circuit 200 when the external power supply voltage is raised from 0V to 5V.

FIG. 7 is an operation waveform chart for use in illustration of the operation of voltage generating circuit 200 when the external power supply voltage is raised from 0V to 5V.

Referring to FIG. 7, at time t0, the external power supply is activated and external power supply voltage VCE starts to rise. External power supply voltage VCE reaches V2 (2.6V), the reference voltage of comparator with delay circuit 72 at time t1, and then until a prescribed time delay td passes by the function of the delay circuit, the output of comparator with delay circuit 72 is at an L level, so that voltage cut off transistor 76 maintains its off state. During the period in which voltage cut off transistor 76 is off, the internal power supply interconnection is not supplied with voltage.

At time t2, external power supply voltage VCE reaches reference voltage V1 (3.9V), the output of comparator 40 attains an H level. Voltage switch transistor 50 is turned off accordingly to disconnect the external power supply interconnection and the internal power supply interconnection and regulator circuit 30 is activated to start generating the internal power supply voltage.

At time t3 after a prescribed time delay td since time t1, the output of comparator with delay circuit 72 attains an H level, and voltage cut off transistor 76 is turned on accordingly, so that voltage starts to be supplied to the internal power supply interconnection.

Herein, time delay td is set in view of the responsiveness at the activation of external power supply voltage VCE, so that the output voltage of regulator circuit 30 can be constantly supplied to internal power supply interconnection 20. Therefore, when the external power supply voltage rises from 0V to 5V, external power supply voltage VCE will not be directly supplied to internal power supply interconnection 20, and therefore voltage exceeding the rated value (3.3V) for the internal power supply voltage can be prevented from being generated irrespectively of the response speed of the comparator.

Figure 8:
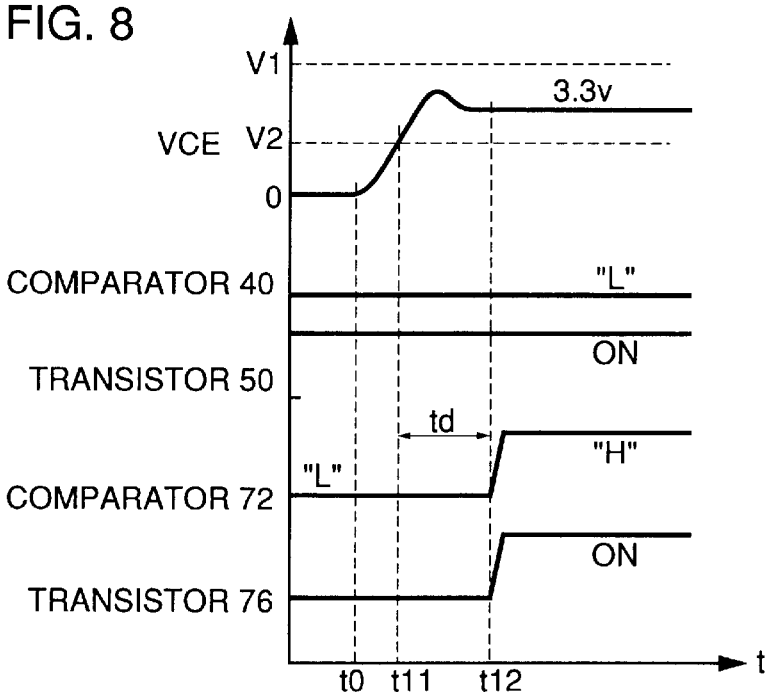
FIG. 8 is an operation waveform chart for use in illustration of the operation of voltage generating circuit 200 when the external power supply voltage is raised from 0V to 3.3V.

FIG. 8 is an operation waveform chart for use in illustration of the operation of voltage generating circuit 200 when the external power supply voltage is raised from 0V to 3.3V.

Referring to FIG. 8, at time t0, the external power supply is activated and external power supply voltage VCE starts rising. External power supply voltage VCE reaches reference voltage V2 (2.6V) for comparator with delay circuit 72 at time t11, the output of comparator with delay circuit 72 is maintained at an L level until a prescribed time delay td passes by the function of the delay circuit, and therefore voltage cut off transistor 76 maintains its off state. When voltage cut off transistor 76 is in an off state, the internal power supply interconnection is not supplied with voltage.

Meanwhile, the rated value for the external power supply voltage (3.3V) is lower than the reference voltage V1 (3.9V) of comparator 40, the output of comparator 40 is constant at an L level. However, since voltage cut off transistor 76 is in an off state, the internal power supply interconnection is not provided with voltage.

At time t12 after a prescribed time delay td since time t11, when the output of comparator with delay circuit 72 attains an H level, voltage cut off transistor 76 is turned on.

At time t12, voltage switch transistor 50 is kept in an on state, and inactivated by regulator circuit 30. As a result, when transistor 50 is turned on, external power supply interconnection 10 and internal power supply interconnection 20 are connected.

If delay time td is set in view of the time until external power supply voltage VCE attains a steady state, transient peak voltage exceeding the rated value (3.3V) will not be generated at internal power supply interconnection 20 by directly supplied external power supply voltage VCE.

Therefore, if the external power supply voltage is from 0V to 3.3V, voltage exceeding the rated value (3.3V) can be prevented from being generated as the internal power supply voltage. Furthermore, regulator circuit 30 is inactivated so that the power consumption can be reduced.

Similarly to voltage generating circuit 110, MOS transistors with small resistance are employed for voltage switch transistor 50 and voltage cut off transistor 76, so that voltage drop between external power supply voltage VCE and internal power supply voltage Vcc can be restrained at a low level.

Thus, in a rising timing of the external power supply voltage, the supply of voltage to internal power supply interconnection 20 is stopped for a prescribed time period until the external power supply voltage attains a steady state, the internal power supply voltage can be stably controlled so as not to exceed the rated voltage although the internal power supply voltage cannot be supplied immediately after the activation in this case.

Modification of Second Embodiment

Figure 9:
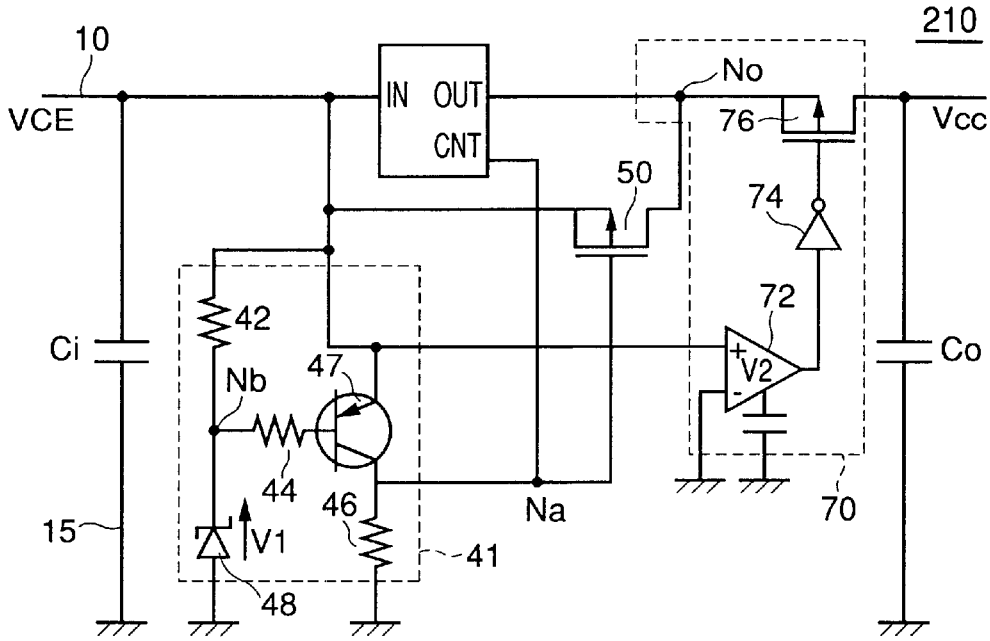
FIG. 9 is a circuit diagram of the general configuration of a voltage generating circuit 210 according to a modification of the second embodiment.

FIG. 9 is a circuit diagram of the configuration of a voltage generating circuit 210 according to a modification of the second embodiment.

Referring to FIG. 9, voltage generating circuit 210 is different from voltage generating circuit 200 according to the second embodiment in that a voltage comparison circuit 41 is provided in place of comparator 40. The other configuration and operation are the same as those of voltage generating circuit 200, and therefore no additional description is provided.

The configuration and operation of voltage comparison circuit 41 is the same as those of voltage generating circuit 120 according to the modification of the first embodiment, and no additional description is provided.

Voltage comparison circuit 41 provides the same effects as comparator 40 in voltage generating circuit 200. Voltage generating circuit 210 operates similarly to voltage generating circuit 200, and the same effects can be provided by voltage comparison circuit 41 formed by a zener diode, a transistor and resistors unlike comparator 40 using an operation amplifier, so that the configuration according to this modification can be advantageously formed less costly.

Third Embodiment

Figure 10:
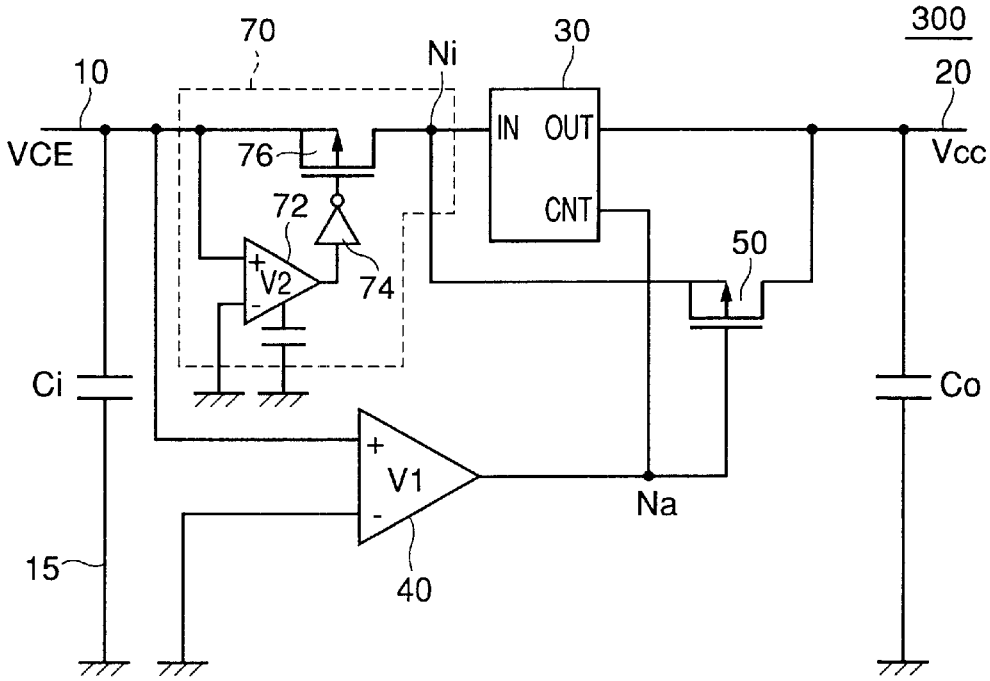
FIG. 10 is a circuit diagram of the general configuration of a voltage generating circuit 300 according to a third embodiment of the present invention.

FIG. 10 is a circuit diagram of the configuration of a voltage generating circuit 300 according to a third embodiment of the present invention.

Referring to FIG. 10, voltage generating circuit 300 is different from voltage generating circuit 100 in that there is provided a voltage cut off control circuit 70 between external power supply interconnection 10 and node Ni connected to the input terminal of regulator circuit 30 and to voltage switch transistor 50.

Voltage generating circuit 300 disconnects regulator circuit 30 and voltage switch transistor 50 and external power supply interconnection 10 to stop the supply of voltage to internal power supply interconnection 20 until external power supply voltage VCE attains a steady state. After external power supply voltage VCE is stable, voltage generating circuit 300 turns on voltage cut off transistor 76 to perform the same operation as that of voltage generating circuit 100.

The operation timings of comparator 40, comparator with delay circuit 72, transistor 62 and voltage switch transistor 50 are the same as those of voltage generating circuit 200 described in conjunction with FIGS. 7 and 8, and therefore no additional description is provided.

Thus, similarly to voltage generating circuit 200, though the internal power supply voltage cannot be supplied immediately after the activation, internal power supply voltage Vcc can be surely prevented from being instantaneously raised to the level of the rated voltage or higher in a rising of external power supply voltage VCE, so that elements in the internal circuit, i.e., a load can be prevented from being destroyed by voltage equal to or higher than the rated voltage applied to the internal circuit.

Modification of Third Embodiment

Figure 11:
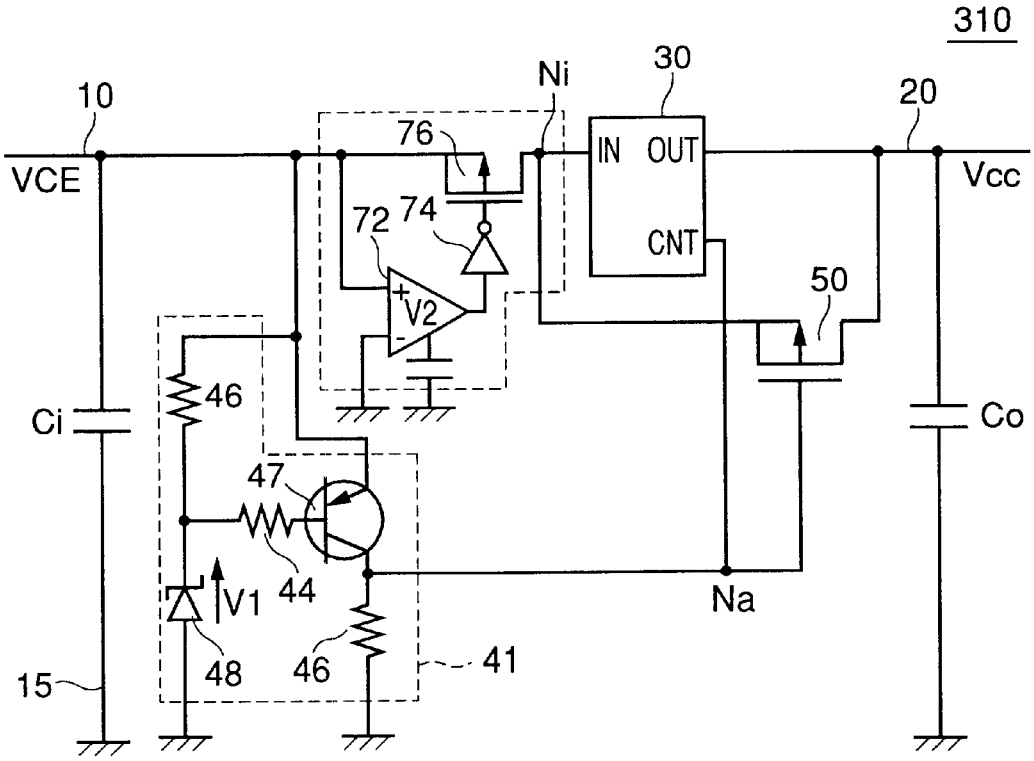
FIG. 11 is a circuit diagram of the general configuration of a voltage generating circuit 310 according to a modification of the third embodiment.
Figure 12:
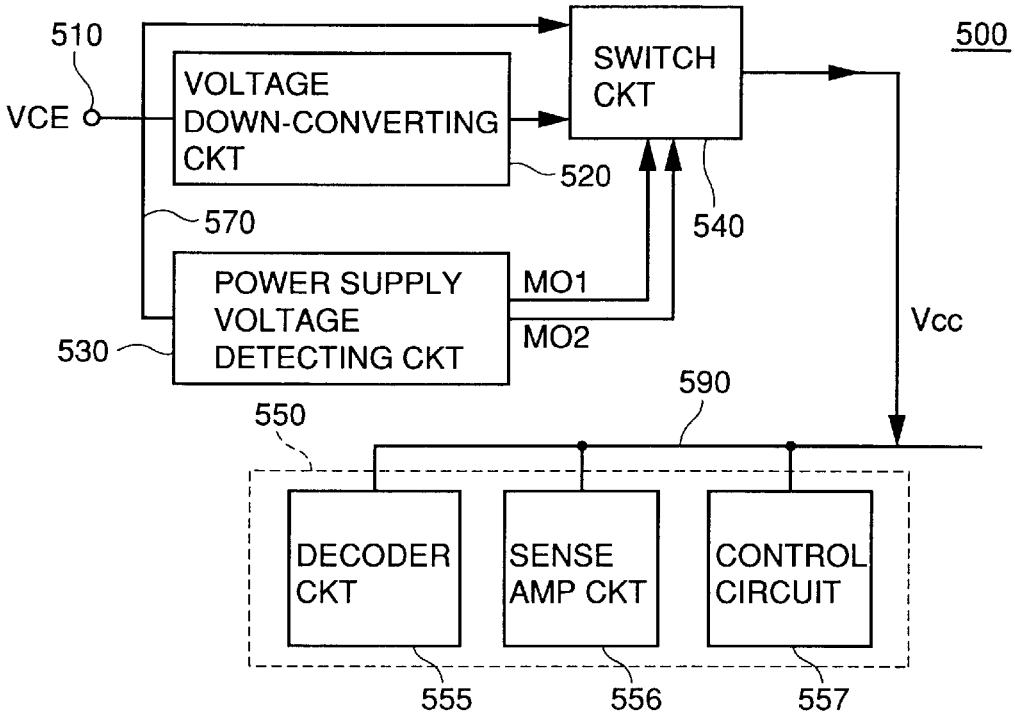
FIG. 12 PRIOR ART
FIG. 12 is a schematic block diagram of the general configuration of a conventional voltage generating circuit 500.
Figure 13:
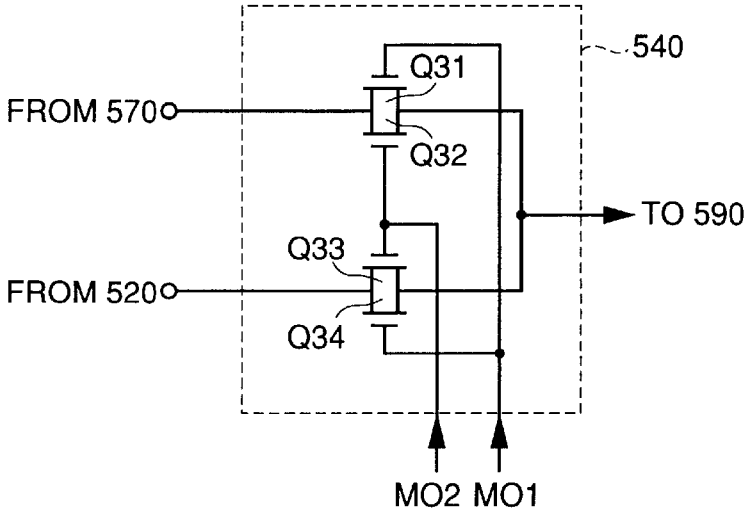
FIG. 13 PRIOR ART
FIG. 13 is a circuit diagram of the configuration of a switch circuit 540.
Figure 14:
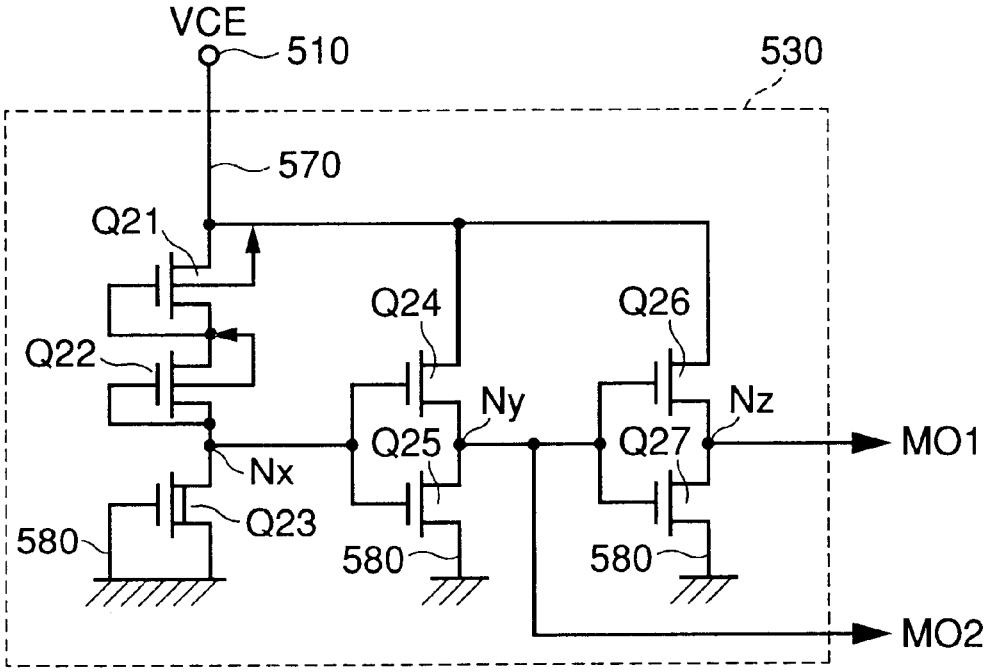
FIG. 14 PRIOR ART
FIG. 14 is a circuit diagram of the configuration of a power supply voltage detecting circuit 530.

FIG. 11 is a circuit diagram of the configuration of a voltage generating circuit 310 according to a modification of the third embodiment.

Referring to FIG. 11, voltage generating circuit 310 is different from voltage generating circuit 300 according to the third embodiment in that a voltage comparison circuit 41 is provided in place of comparator 40. The other configuration and operation are the same as those of voltage generating circuit 300, and no additional description is provided.

The configuration and operation of voltage comparison circuit 41 are the same as those of voltage generating circuit 120 according to the modification of the first embodiment, and no additional description is provided.

Voltage comparison circuit 41 provides the same effects as those of comparator 40 in voltage generating circuit 300. Voltage generating circuit 310 operates similarly to voltage generating circuit 300, but the same effects are provided advantageously less costly by voltage comparison circuit 41 formed by a zener diode, a transistor and resistors.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage generating circuit receiving an external power supply voltage and generating an operation power supply voltage of a predetermined value, comprising:

an external power supply interconnection for transmitting said external power supply voltage;

an internal power supply interconnection for transmitting said operation power supply voltage;

a control node:

an output switch circuit activated based on the voltage level of said control node for connecting said external power supply interconnection and said internal power supply interconnection;

an auxiliary voltage generating circuit, connected between said external power supply interconnection and said internal power supply interconnection and activated complementary to said output switch circuit based on the voltage level of said control node, for supplying the voltage of said predetermined value to said internal power supply interconnection; and a voltage switch control circuit for controlling the voltage of said control node to activate said auxiliary voltage generating circuit before the voltage level of said external power supply interconnection is stabilized at an activation of said external power supply interconnection and to activate one of said output switch circuit and said auxiliary voltage generating circuit, which is selected according to a relationship between said external power supply voltage and said predetermined value after the voltage level of said external power supply interconnection is stabilized.

2. The voltage generating circuit according to claim 1, wherein said voltage switch control circuit activates said output switch circuit based on the voltage level of said external power supply interconnection after a prescribed time period since said activation of said external power supply interconnection.

3. The voltage generating circuit according to claim 2, wherein said voltage switch control circuit sets the voltage level of said control node to one of a first voltage to activate said output switch circuit and a second voltage to activate said auxiliary voltage generating circuit, and said voltage switch control circuit comprises, a first voltage comparison circuit for activating a first control signal when the voltage level of said external power supply interconnection is at least at the level of a first reference voltage set higher than said predetermined value, a second voltage comparison circuit for activating a second control signal when said prescribed time period has passed and said voltage level of said external power supply interconnection has become at least a second reference voltage set lower than said predetermined value, and a logical operation circuit for setting the voltage level of said control node to the level of said first voltage when said first control signal is inactivated and said second control signal is activated.

4. The voltage generating circuit according to claim 3, wherein said first voltage comparison circuit comprises, a first power supply interconnection for supplying a voltage corresponding to an activated state of said first control signal, a second power supply interconnection for supplying a voltage corresponding an inactivated state of said first control signal, a transistor provided to electrically couple said first power supply interconnection and a node from which said first control signal is output, a zener diode connected in a direction from said second power supply interconnection to an input electrode of said transistor as a forward direction and having a breakdown voltage equal to said first reference voltage, a first resistor connected between said external power supply interconnection and the input electrode of said transistor, and a second resistor connected between said node and said second power supply interconnection.

5. The voltage generating circuit according to claim 2, wherein said prescribed time period is set based on a time period after said external power supply voltage exceeds a prescribed voltage lower than said predetermined value at said activation of said external power supply interconnection.

6. A voltage generating circuit receiving an external power supply voltage and generating an operation power supply voltage of a predetermined value, comprising:

an external power supply interconnection for transmitting said external power supply voltage:

an internal power supply interconnection for transmitting said external power supply voltage;

a control node;

an output switch circuit activated based on the voltage level of said control node for supplying a voltage from said external power supply interconnection to said internal power supply interconnection;

an auxiliary voltage generating circuit, connected between said external power supply interconnection and said internal power supply interconnection and activated complementary to said output switch circuit based on the voltage level of said control node, for supplying the voltage of said predetermined value to said internal power supply interconnection;

a voltage switch control circuit for controlling the voltage of said control node to activate one of said output switch circuit and said auxiliary voltage generating circuit, which is selected according to a relationship between said external power supply voltage and said predetermined value; and a voltage supply cut off circuit for stopping voltage supply by said external power supply interconnection and said auxiliary voltage generating circuit to the internal power supply interconnection until the voltage level of said external power supply interconnection is stabilized.

7. The voltage generating circuit according to claim 6, wherein said voltage supply cut off circuit stops voltage supply by said external power supply interconnection and said auxiliary voltage generating circuit to said internal power supply interconnection for a prescribed time period after an activation of said external power supply interconnection.

8. The voltage generating circuit according to claim 7, wherein said voltage supply cut off circuit comprises, a node connected to an output terminal of said auxiliary voltage generating circuit and said output switch circuit, a voltage cut off switch for connecting/disconnecting said node to/from said internal power supply interconnection, and a voltage comparison circuit for maintaining a disconnection state of said voltage cut off switch until said prescribed time period has passed and the voltage level of said external power supply voltage has become at least at the level of a first reference voltage set lower than said predetermined value.

9. The voltage generating circuit according to claim 7, wherein said voltage supply cut off circuit comprises, a node connected to an input terminal of said auxiliary voltage generating circuit and said output switch circuit, a voltage cut off switch for connecting/disconnecting said node to/from said internal power supply interconnection, and a voltage comparison circuit for maintaining a disconnection state of said voltage cut off switch until said prescribed time period has passed and the voltage level of said external power supply voltage has become at least at the level of a first reference voltage set lower than said predetermined value.

10. The voltage generating circuit according to claim 7, wherein said voltage switch control circuit controls the voltage of said control node to activate said output switch circuit when the voltage level of said external power supply voltage is at most at the level of a second reference voltage set higher than said predetermined value, and said voltage switch control circuit comprises, a first power supply interconnection which supplies a first voltage to activate said output switch circuit, a second power supply interconnection which supplies a second voltage to activate said auxiliary voltage generating circuit, a transistor provided to electrically connect said second power supply interconnection and said control node, a zener diode connected in a direction from said first power supply interconnection to an input electrode of said transistor as a forward direction and having a breakdown voltage equal to said second reference voltage, a first resistor connected between said external power supply interconnection and the input electrode of said transistor, and a second resistor connected between said transistor and said first power supply interconnection.

11. The voltage generating circuit according to claim 7, wherein said prescribed time period is set based on a time period until the voltage level of said external power supply interconnection is stabilized after the activation.

* * * * *